US005703749A

United States Patent [19]

Prasad

[11] Patent Number: 5,703,749

[45] Date of Patent: Dec. 30, 1997

[54] SAFETY CONTROL SYSTEM RESPONSIVE TO CARBON MONOXIDE SMOKE AND THE LIKE

[76] Inventor: Romeo Prasad, 10 Warren La., Windsor, Conn. 06095

[21] Appl. No.: 735,097

[22] Filed: Oct. 22, 1996

Related U.S. Application Data

[63] Continuation of Ser. No. 347,851, Dec. 1, 1994, abandoned.

[51] Int. Cl.[6] ..... H01H 47/22

[52] U.S. Cl. ..... 361/170; 307/117

[58] Field of Search ..... 361/170; 307/112, 307/116–118, 326, 328; 73/23.2, 23.34, 31.01; 340/628

[56] References Cited

U.S. PATENT DOCUMENTS

| | | | |
|---|---|---|---|
| 3,727,073 | 4/1973 | Cade | 361/170 |
| 3,766,441 | 10/1973 | Gray | 361/170 |
| 3,915,236 | 10/1975 | Stichling | 169/61 |
| 4,032,286 | 6/1977 | Kobayashi et al. | 431/76 |
| 4,171,944 | 10/1979 | Hirschmann | 431/22 |
| 4,334,258 | 6/1982 | Seeman et al. | 361/170 |
| 4,833,461 | 5/1989 | Yeager | 361/170 |
| 4,841,287 | 6/1989 | Flig et al. | 361/170 |
| 4,930,488 | 6/1990 | Pearman et al. | 126/39 E |
| 5,180,925 | 1/1993 | Lieb | 307/114 |
| 5,379,026 | 1/1995 | Whittle | 340/632 |
| 5,508,568 | 4/1996 | Mammen | 307/117 |

*Primary Examiner*—Fritz Fleming

*Attorney, Agent, or Firm*—Fishman, Dionne, Cantor & Colburn

[57] ABSTRACT

Apparatus is disclosed for preventing injury to an occupant of an enclosed space as the result of exposure to a noxious gas. The apparatus shuts a source of noxious gases, when an unsafe ambient condition is sensed. More particularly, the unsafe condition is typically the presence of the noxious gas in the enclosed space. In some forms of the invention the apparatus also includes structure for latching that upon sensing an unsafe condition continues to send a signal to shut off the source of noxious gas. Some forms of the apparatus may further include an override for the latching aspect of the structure. The override may be a manually operated push button that operates a relay. The apparatus for shutting down the source of noxious gases is a relay in some forms of the invention and that relay may be normally closed in some embodiments.

12 Claims, 2 Drawing Sheets

SAFETY CONTROL SYSTEM RESPONSIVE TO CARBON MONOXIDE SMOKE AND THE LIKE

This application is a continuation of application Ser. No. 08/347,851 filed on Dec. 1, 1994, now abandoned.

BACKGROUND OF THE INVENTION

The invention relates to systems for shutting down dangerous apparatus in response to carbon monoxide, smoke or other noxious gases.

Conventional carbon monoxide and smoke detectors that sound an alarm are of substantial importance in preventing death and injury to many people and animals. While such alarm devices are of great importance, there is a need for a more proactive devices. More specifically, it is desirable to have a system that will take affirmative action to reduce the risk to people and animals in an enclosed area.

One danger that is of concern, is the danger associated with a young child turning a knob on a gas stove and releasing poisonous gases into the interior of a home or other building. Similarly, there is a danger that a young child might turn on an appliance, such as a stove, that would cause ignition of some flammable material.

Stated another way, it is an object of the present invention to provide apparatus that will turn off an appliance that is a potential source of smoke or carbon monoxide.

It is another object of the invention to provide a system that will reduce the risk to the occupant of a building being exposed to fire, smoke or carbon monoxide as the result of the unknowing act of a child.

Still another object of the invention is to provide apparatus that will turn off an electrical appliance or shut off the gas being supplied to a stove or other apparatus when a danger exits.

Yet another object of the invention is to provide apparatus that will enable an operator to enter a predetermined code that will ensure that a given relatively dangerous apparatus will not be turned on by a child or other person unless that person knows the predetermined code.

SUMMARY OF THE INVENTION

It has now been found that these and other objects of the invention may be attained by an apparatus for preventing injury from noxious gas. The apparatus includes a shut off circuit for interrupting a source of electricity to an electrical appliance and interrupting a source of gas to a gas appliance. A controller having first and second states controls the shut off circuit. A sensor coupled to said controller senses the presence of a noxious gas and causes a change from the first state to the second state when the presence of a noxious gas exists. The change to the second state causes the shut off circuit to interrupt the source of electricity and the source of gas.

In some forms of the invention, the apparatus also includes a latch for placing the controller in the second state. The apparatus may further include a switch for overriding the latch. The switch may be a manually operated push button and the controller may be relay.

The shut off circuit in an exemplary embodiment is a relay that is normally closed In an exemplary embodiment, the controller is a relay that is normally open in some embodiments.

In an exemplary embodiment, the relay that is a part of the controller includes a holding coil and the switch interrupts electrical power to the holding coil of the relay that is in the controller. A keypad may be coupled to the controller to selectively prevent change of state of the controller from the first state to the second state.

BRIEF DESCRIPTION OF THE DRAWING

The invention will be better under stated by understood by reference to the accompanying drawing, in which.

DESCRIPTION OF THE PREFERRED EMBODIMENT

Figure 1:
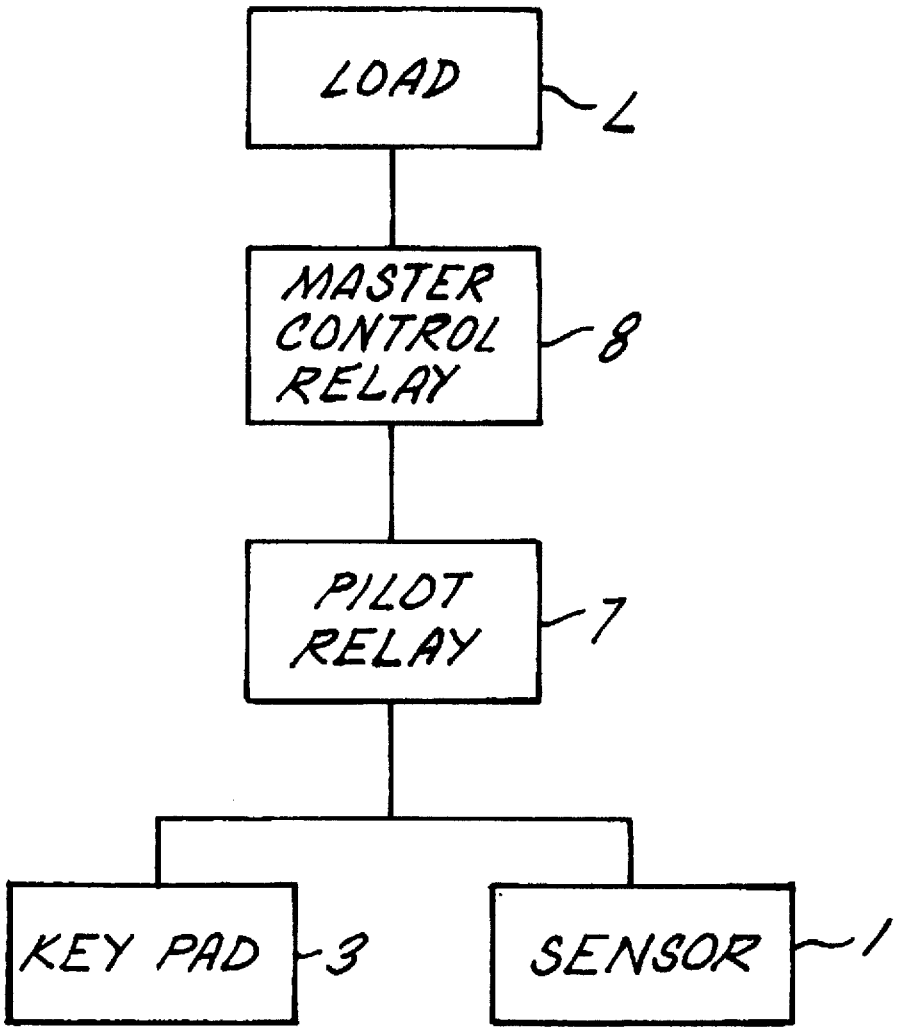
FIG. 1 is a block diagram of one form of the apparatus in accordance with the invention.

Referring now to FIG. 1 there is shown a block diagram illustrating the general nature of the present apparatus. In this apparatus a sensor 1 operates a pilot relay 7 that operates a master control relay 8 to shut down a load L when a dangerous condition occurs. Some forms of the invention also include a key pad 3 which allows manual shutdown of the load L when the operator chooses such action.

Figure 2:
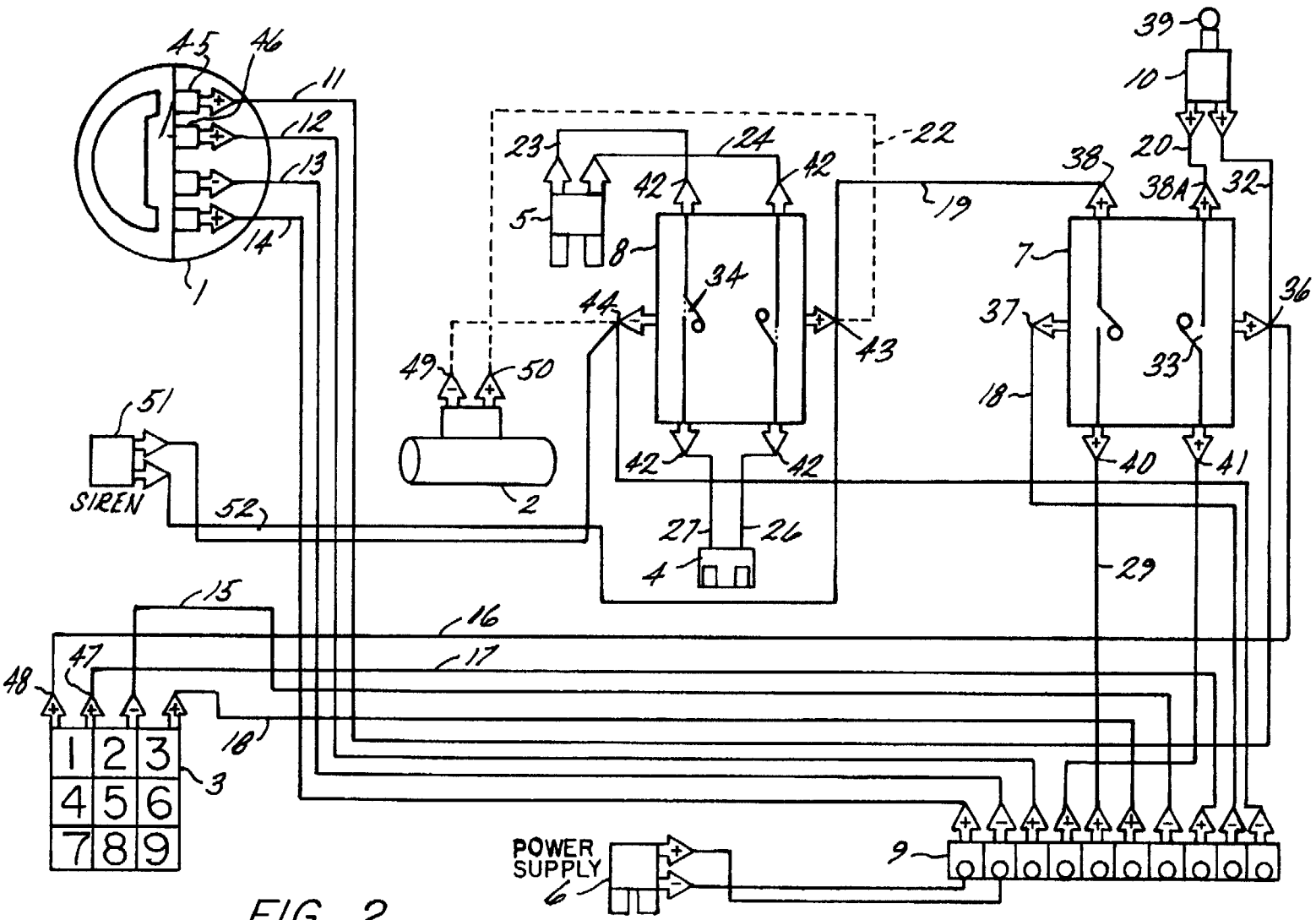
FIG. 2 is an electrical schematic drawing of the apparatus illustrated in FIG. 1 showing the interrelationships in greater detail.

The various aspects of the invention are much more detailed and reference is accordingly made to FIG. 2 for a more detailed explanation of the present invention. FIG. 2 illustrates the same sensor 1, pilot relay 7, and master control relay 8 that is shown in FIG. 1.

Sensor 1 is in the preferred embodiment is a commercially available device and is preferably of a type that is a combination carbon monoxide and smoke detector. Although the preferred embodiment of the invention is this particular type of detector, it will be understood that a sensor such as a device that would sense the oxygen content of the ambient air and that would recognize a lowered oxygen content of the ambient air would also be desirable for some applications.

In FIG. 2 the terminals of each of the devices are shown schematically by arrowheads. The terminals of the sensor 1 that are connected respectively to wires 13, 14 are input terminals of the sensor 1. These terminals are coupled to ground and power terminals of a terminal strip 9. It will be understood that the terminal strip 9 includes a plurality of terminals that are provided with power from a twelve volt power supply 6. All terminals marked with a "+" sign are at +12 volts D.C. potential and all terminals marked with a "–" sign are at ground potential. Thus, it will be seen that the wires 14 and 13 are respectively at 12 volts D.C. and ground potential.

The sensor 1 operates continuously with the power applied to the terminals connected to conductors 13, 14. In addition, power is coupled to the sensor 1 via a wire 12. When the sensor 1 detects an unsafe action, 12 volts D.C. is applied to the terminal connected to conductor 11. Power on conductor 12 is accordingly applied to the holding coil of the pilot relay 7 for the duration of the unsafe condition.

The pilot rely 7 is provided with a terminal 37 which is connected by conductor 18 to ground on the terminal strip 9 at all times. Accordingly, the application of 12 volts D.C. to the terminal 36 energizes the holding coil of the relay 7 causing the normally open contacts thereof to close.

The movement of the two normally open contacts of the relay 7 causes 12 volts D.C. applied at all times to the input terminals of relay 7 by respectively conductors 40, 41 to be applied to the output terminals thereof. These output terminals identified respectively as terminals 38, 38 apply power respectively to a reset switch 10 and the master control relay 8.

The reset switch 10 is a normally closed switch of the momentary type. It will be seen that the 12 volts output on terminal 38A is fed back to the terminal 36 of the relay 7 causing that relay to latch in the closed position until such time as the reset switch 10 is momentarily opened by depression of the button 39.

12 volt power on the output terminal 38 of the pilot rely 7 is supplied by conductor 19 to the terminal 43 of the master control relay 8. Terminal 43 of the master control relay 8 is the positive terminal of the holding coil of that relay. The terminal 44 of that relay is connected at all times to ground on the terminal strip 9. The master control relay 8 has two normally closed contacts that are opened when power is applied to the terminal 43.

In a typical embodiment a plug 5 is connected to a source of electrical power such as in the socket in a residential home. This power is coupled by respective conductors 23, 24 to terminals 42, 42 of the master control relay 8. Accordingly, the normally closed contacts 34, 34 of the master control relay 8 conduct power to the output terminals 42, 42 and thence the conductors 47, 26 to a socket 4 to supply power to a load L.

In an optional embodiment the contacts 44, 43 of the holding coil of the relay 8 are connected in parallel correction the holding coil is in parallel with a solenoid valve having terminals 49, 50. This solenoid valve in the preferred embodiment is a normally open valve. If power is supplied to the connectors 29, 50 (and the holding coil of the relay 8,) the solenoid valve will close and stop any possible flow in the solenoid valve. In other words, the system will ensure that there is no continued flow of hazardous gas, such as to a stove.

In another optional embodiment of the invention, the apparatus also includes a key pad 3. The key pad 3 is coupled by conductors 15, 18 to respectively ground and 12 volts D.C. If an operator manually selects a predetermined numeric code the power to the load L will be shut off and/or gas will no longer be supplied to a given apparatus. Output terminals 48, 47, are connected respectively to conductors 16, 17. Terminal 47 is also connected to 12 volts D.C. at all times. If the predetermined code has been entered the terminal 47 will be connected to the terminal 48 and the 12 volts entering the key pad assembly 3 on conductor 17 will pass out on conductor 16 causing energy to reach the terminal 36 of the pilot relay 7. As described above this will cause power to flow to the holding coil of the relay 8 and thus cause interruption of electoral power to a given load or interruption of a flammable gas to a "load".

Those skilled in the article room will recognize that in various embodiments of the invention the apparatus may also include a siren 51 which is coupled by conductors 52 to terminal 44 of master control relay 8 and terminal 43 of master control relay 8. It will also be under said that the keypad 3 as well as the siren 51 are optional features. Those skilled in the art will recognize that other locking devices such as a key operated switch may be used instead of the keypad 3 that is used in the preferred embodiment.

Still other variations will be apparent to those skilled in the art upon reading the present disclosure. For example, solid state relays my be substituted for the relays shown herein. Similarly, other computer hardware and software may also be used to practice the present invention. Accordingly, the present invention is accordingly limited only by the following claims:

I claim:

1. Apparatus for preventing injury from a noxious gas which comprises:

a shut off circuit for interrupting a source of electricity to an electrical appliance and interrupting a source of gas to a gas appliance;

a controller for controlling said shut off circuit, said controller having first and second states;

a sensor for sensing the presence of a noxious gas, said sensor being coupled to said controller to cause a change from said first state to said second state therein when the presence of a noxious gas exists, said change to said second state therein causing said shut off circuit to interrupt the source of electricity and the source of gas.

2. The apparatus as described in claim 1 further including:

a latch for placing said controller in said second state.

3. The apparatus as described in claim 2 further including:

a switch for overriding said latch.

4. The apparatus as described in claim 3 wherein:

said switch is a manually operated push button.

5. The apparatus as described in claim 4 wherein:

said controller is a relay.

6. The apparatus as described in claim 5 wherein:

said shut off circuit is a relay.

7. The apparatus as described in claim 6 wherein:

said shut off circuit is a relay that is normally closed.

8. The apparatus as described in claim 7 wherein:

said controller is a relay that is normally open.

9. The apparatus as described in claim 8 wherein:

said relay that is a part of said controller includes a holding coil and said switch interrupts electrical power to the holding coil of the relay that is in said controller.

10. The apparatus as described in claim 9 further including:

a keypad coupled to said relay in said controller, said keypad being selectively able to prevent change of state of said controller from said first state to said second state.

11. The apparatus of claim 1 further comprising:

a keypad coupled to said controller, said keypad being selectively able to prevent change of state of said controller from said first state to said second state.

12. Apparatus for preventing injury from a noxious gas which comprises:

a shut off circuit for interrupting a source of electricity to an electrical appliance that is the source of the noxious gas and a source of gas to a gas appliance that is the source of the noxious gas;

a controller for controlling sad shut off circuit, said controller having first and second states;

a sensor for sensing the presence of a noxious gas, said sensor being coupled to said controller to cause a change from said first state to said second state therein when the presence of a noxious gas exists, said change to said second state therein causing said shut off circuit to interrupt the source of electricity and the source of gas.

* * * * *